US006457335B1

(12) United States Patent
Fleissner

(10) Patent No.: US 6,457,335 B1
(45) Date of Patent: Oct. 1, 2002

(54) DEVICE WITH NOZZLE BEAM FOR PRODUCING STREAMS OF LIQUID FOR SPRAYING FIBERS IN A WEB OF GOODS

(75) Inventor: Gerold Fleissner, Zug (CH)

(73) Assignee: Fleissner GmbH & Co. Maschinenfabrik, Egelsbach (DE)

( * ) Notice: Subject to any disclaimer, the term of this patent is extended or adjusted under 35 U.S.C. 154(b) by 0 days.

(21) Appl. No.: 09/574,496

(22) Filed: May 19, 2000

(30) Foreign Application Priority Data

May 21, 1999 (DE) ..... 199 23 591

(51) Int. Cl.[7] ..... D06B 5/08

(52) U.S. Cl. ..... 68/19.1; 68/20; 68/205 R; 15/309.1; 15/302

(58) Field of Search ..... 68/205 R, 20, 68/19.1; 15/302, 309.1, 345, 346; 162/275, 276, 199, 279; 118/324, 325, 326

(56) References Cited

U.S. PATENT DOCUMENTS 3,741,157 A * 6/1973 Krause
3,749,053 A * 7/1973 Timson
3,766,756 A * 10/1973 Farrar
3,841,858 A * 10/1974 Akashi et al.
3,973,902 A * 8/1976 Zimmermann et al.
4,003,226 A * 1/1977 Holdsworth
4,018,483 A * 4/1977 Smith
4,042,363 A * 8/1977 Maeda et al.
4,064,832 A * 12/1977 Chujo et al.
4,102,299 A * 7/1978 Wallsten
4,351,267 A * 9/1982 Kalbskopf et al.
4,397,259 A * 8/1983 Kanda et al.
4,476,158 A * 10/1984 Baumberger et al.
4,558,657 A * 12/1985 Rohrbach
4,691,417 A 9/1987 Vuilaume
4,870,462 A * 9/1989 Day
4,905,500 A * 3/1990 Mason
4,928,627 A * 5/1990 Linder
4,944,808 A * 7/1990 Sugiyama et al.
5,340,609 A * 8/1994 Arthur et al.
5,522,911 A * 6/1996 Terneu et al.
5,603,775 A * 2/1997 Sjoberg
5,783,044 A * 7/1998 Schneider et al.
5,849,321 A * 12/1998 Linnonmaa
5,944,956 A * 8/1999 Marcheggiani
5,964,956 A * 10/1999 Straub et al.
6,051,076 A * 4/2000 Oechsle et al.

* cited by examiner

*Primary Examiner*—Frankie L. Stinson
(74) *Attorney, Agent, or Firm*—Antonelli, Terry, Stout & Kraus, LLP

(57) ABSTRACT

Device with a nozzle beam for producing fluid streams for striking the fibers of a web of goods by streams.

The fluid spraying against the underside of the nozzle beam must be captured. For this purpose, a device is used Fat is located to the side of the nozzle beam over its length. A funnel-shaped slot is provided at the edge of the nozzle beam, at whose inner end a suction slot approximately 2 mm high is formed. If a sufficiently low vacuum is connected to the otherwise completely enclosed device, all of the drops from the underside of the nozzle beam can be sucked up safely for the goods to be needled, including a spray fog.

9 Claims, 1 Drawing Sheet

DEVICE WITH NOZZLE BEAM FOR PRODUCING STREAMS OF LIQUID FOR SPRAYING FIBERS IN A WEB OF GOODS

BACKGROUND OF THE INVENTION

A nozzle beam to produce streams of liquid is known for example from EP-A0 725 175. Water streams emerge at high pressures of up to 600 bar from the nozzle slot located in the lower part of the beam and strike the web of goods passing by immediately beneath, held by a substrate. The water streams are exposed beneath the substrate to suction intended to carry away the liquid. Practice has shown however that not all of the liquid sprayed can be drawn off immediately, but a portion is reflected off the goods, at the substrate, and sprayed back against the underside of the nozzle beam. From there this liquid then drips onto the web of goods, which is to be avoided.

It is known from practice to arrange a liquid-catching device at least on one long side of the nozzle beam parallel to its length and in the immediate vicinity of the outer edge of the lower part, said device being intended to catch the liquid running off the underside of the nozzle beam.

SUMMARY OF THE INVENTION

The goal of the invention is to improve a fluid catching gutter of this kind in such fashion that it immediately receives completely the fluid that reaches the underside of the nozzle beam, possibly including a water fog that is produced when spraying.

On the basis of the device of the type recited at the outset, the solution that has been found consists in the fluid-catching device being designed as a suction tube with a lengthwise suction slot located as a suction tube with a lengthwise slot providing suction along the underside of the nozzle beam. The fluid is therefore not only to be caught but immediately drawn away along the entire beam. It is advantageous to produce the vacuum in the catching device by means of the pump that also provides the vacuum in the suction slot at the substrate.

In order for the vacuum that can be produced in the tube enclosed on all sides or the like to act uniformly over the length of the nozzle beam, the depth of the suction slot should be small, for example 1–5 mm. It is advantageous for this suction slot to be located at the end of a funnel and for the funnel to extend by its underside up to and even beneath the underside of the nozzle beam. There is little space available were since the goods to be treated must be guided very close to the outlet of the water stream from the nozzle sheet. This is particularly true when the substrate is an endless belt; slightly more space is provided when the substrate is a screen roller which, because of its curvature, leaves more room for a closer arrangement of the suction funnel. The invention proposes a solution for this arrangement and a special design which will be described in greater detail in conjunction with the example shown in the drawing.

DETAILED DESCRIPTION OF THE PREFERRED EMBODIMENTS

Figure 2:
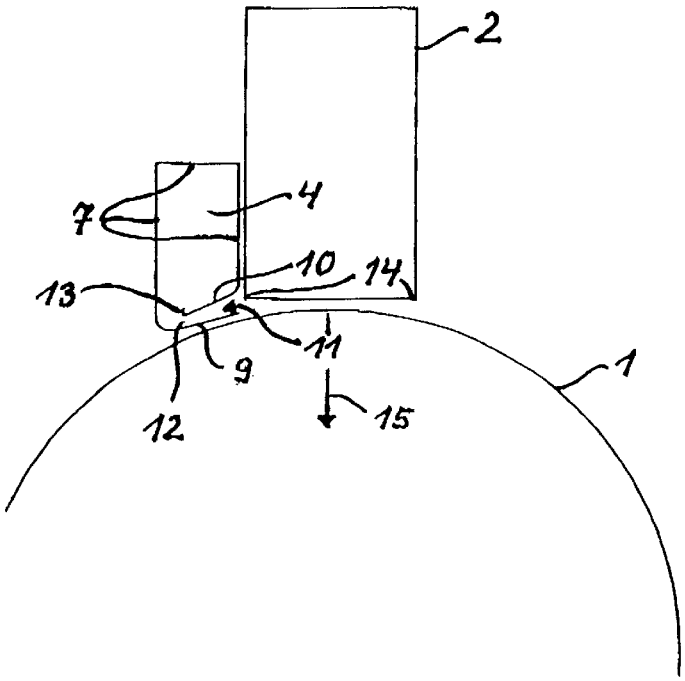
FIG. 2 also shows an enlarged portion.

Two nozzles beams 2 and 3 are associated with screen roller 1, one precisely vertically above and another immediately next to it and directed diagonally downward. Fluid suction devices 4, 5 are located close to nozzle beam 2 on both sides of nozzle beam 2 at its underside. Such a device 6 is required on nozzle beam 3, only on the lower side, since the fluid hanging from the underside of the nozzle beam runs spontaneously in this direction along the underside. As can be seen even better from FIG. 2, the catching device consists of an approximately rectangularly bent sheet 7 which is open at a suction slot 12 in the underside of the box-shaped tube, but is otherwise closed at the ends. The interior space is connected to a pump 8 which also places the suction slot 15, not shown individually, under suction below the nozzle streams striking screen roller 1 and is conventionally located there. The fluid-catching device 4–6 is bent out of a sheet 7 that extends along nozzle beam 2, 3, whose end surfaces 9, 10 partially overlap one another to form funnel-shaped lengthwise slot 11 and merge conically with one another at suction slot 12. Suction slot 12 is formed by the inner end edge 13 of end surface 10 of sheet 7 together with the end surface 9 extending up to corner edge 14 of nozzle beam 2.

Figure 1:
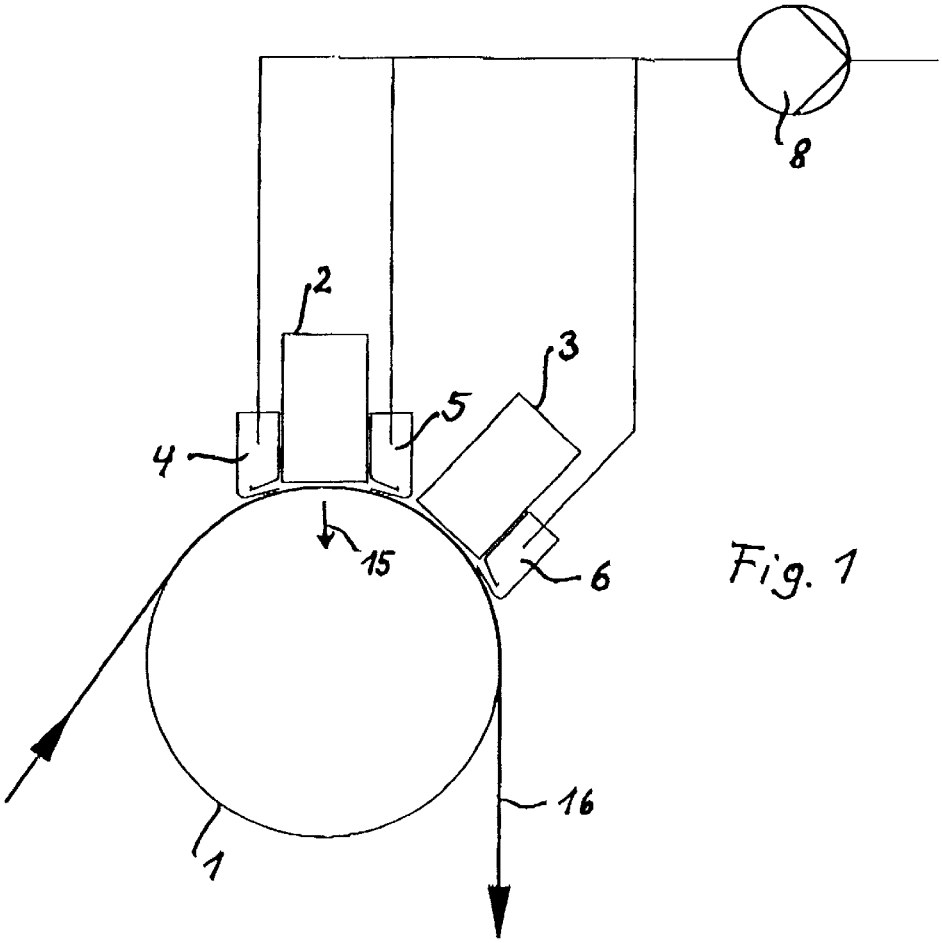
FIG. 1 shows a screen roller in cross section with a nozzle beam associated therewith, for example according to EP-A0 725 175 [shown schematically].

The fluid runs precisely up to this corner edge 14 because of gravity at least on the nozzle beam 3 according to FIG. 1 and then drips onto web of goods 16. The drops hanging from the lower side of the nozzle beam come loose over its entire surface so that only a powerful suction force can remove them completely, said force acting on suction slot 12. In order for a corresponding vacuum to develop, suction slot 12 has only a limited depth, 2 mm for example. Lower end surface 9 extends up to edge 14, possibly also slightly toward the middle of nozzle beam 2, depending on how much space is available for it.

As a result of this design, not only can the fluid dripping from edge 14 of nozzle beam 2, 3 be caught, but also all of the moisture that reaches the underside. The suction from pump 8 prevents drops from accumulating on the underside of nozzle beam 2, 3, the fluid hanging there is removed immediately, even the liquid fog produced by spraying.

What is claimed is:

1. A device for processing a textile web of fibers, comprising:

a screen roller for transporting the textile web in one direction;

a nozzle beam for producing fluid streams for striking the fibers of the textile web being transported on the screen roller, the nozzle beam comprising an upper part and a lower part extending over a working width of the textile web, the upper part including a pressure chamber to which pressurized fluid is supplied, and the lower part including a nozzle sheet with nozzle holes supported in a fluid-tight manner;

a suction device within the screen roller beneath area to which the textile web is exposed to fluid streams from the nozzle beam; and a fluid catching device including a suction slot connected to a suction source, the suction slot facing the nozzle beam and being provided adjacent a lower edge of the nozzle beam and parallel to a lengthwise extension of the nozzle beam, the suction slot having a lower edge provided at a position lower than a lower edge of the nozzle beam.

2. Device according to claim 1 characterized in that the fluid-catching device with the exception of suction slot is sealed all the way around and closed airtight at its ends to form a hollow space within the fluid catching device, the hollow space being connected to the suction source.

3. Device according to claim 1 characterized in that the suction slot has a height of 1–10.

4. Device according to claim 1 characterized in that a funnel-shaped catching gutter abuts the suction slot at the underside of nozzle beam.

5. Device according to claim 4 characterized in that the funnel-shaped catching gutter comprises a lower end that extends lengthwise and an upper end area of a sheet that forms the fluid-catching device, the suction slot being formed at a narrow point of the funnel-shaped catching gutter.

6. Device according to claim 5 characterized in that the lower end of the funnel-shaped catching gutter is held in the immediate vicinity of the screen roller and extends at least up to an outer edge of an underside of the nozzle beam.

7. Device according to claim 1 characterized in that the fluid-catching device is bent from a sheet that extends along the nozzle beam, with end areas of said sheet overlapping one another and tapering conically toward one another at the suction slot, an edge of an upper inner end of said sheet, together with a bottom outer end of said sheet, form the suction slot.

8. Device according to claimed 1 characterized in that the hollow space in the fluid-catching device is connected to a suction pump, the suction pump also being connected to the suction device within the screen roller.

9. Device according to claim 1 characterized in that the suction slot has a height of 2 mm.

* * * * *